US012722848B2

(12) United States Patent
Lou et al.

(10) Patent No.: US 12,722,848 B2
(45) Date of Patent: Sep. 1, 2026

(54) CARRYING PALLET

(71) Applicant: MICROONE GREEN MANUFACTURING SOLUTION CO., LTD., Jiaxing City (CN)

(72) Inventors: Jinbo Lou, Jiaxing City (CN); Zheng Ye, Jiaxing City (CN); Yongping Gong, Jiaxing City (CN); Mingsong Hao, Jiaxing City (CN); Xianbing Lu, Jiaxing City (CN); Shengrong Wei, Jiaxing City (CN); Weijie Zhang, Jiaxing City (CN)

(73) Assignee: MICROONE GREEN MANUFACTURING SOLUTION CO., LTD., Jiaxing City (CN)

( * ) Notice: Subject to any disclaimer, the term of this patent is extended or adjusted under 35 U.S.C. 154(b) by 61 days.

(21) Appl. No.: 18/900,141

(22) Filed: Sep. 27, 2024

(65) Prior Publication Data

US 2025/0382096 A1 Dec. 18, 2025

(30) Foreign Application Priority Data

Jun. 17, 2024 (CN) ..... 202421382607.6

(51) Int. Cl.
*B65D 19/00* (2006.01)

(52) U.S. Cl.
CPC ..... *B65D 19/0089* (2013.01); *B65D 2519/00273* (2013.01)

(58) Field of Classification Search
CPC ..... B65D 19/0089; B65D 19/0028; B65D 19/40; B65D 19/0075; B65D 19/0097;
(Continued)

(56) References Cited

U.S. PATENT DOCUMENTS 10,189,601 B2 * 1/2019 Grutt ..... B65D 19/40
2009/0255446 A1 * 10/2009 Kirkpatrick ..... B65D 19/0012 108/51.11

(Continued)

FOREIGN PATENT DOCUMENTS

CH 413723 A * 5/1966 ..... B65D 19/385
CN 204916471 U * 12/2015

(Continued)

OTHER PUBLICATIONS

CN413723 English translation (Year: 1966).*
CN110589176 English translation (Year: 2019).*

*Primary Examiner* — Janet M Wilkens

(57) ABSTRACT

A novel carrying pallet is provided. The novel carrying pallet includes a frame and a support structure located inside the frame. The support structure includes multiple first square tubes, multiple support pillars and a connecting plate. The multiple first square tubes are distributed side by side, and two ends of each of the multiple first square tubes are connected with the frame. An outer side of the connecting plate is connected with the frame. The multiple support pillars are located on the multiple first square tubes and are vertically arranged. The multiple support pillars are connected with the first square tubes and the connecting plate. A foot is arranged at a corresponding one corner of the frame.

7 Claims, 6 Drawing Sheets

(58) Field of Classification Search
CPC ..... B65D 2519/00273; B65D 2519/00736; B65D 2519/00129; B65D 2519/00024; B65D 2519/00293; B65D 2519/00308; B65D 2519/00437; B65D 2519/00059; B65D 2519/00069; B65D 2519/00323; B65D 2519/00572; B65D 2519/00825; B65D 2519/00338; B65D 2519/00562; B65D 2519/00786; B65D 2519/0094
USPC ..... 108/56.1, 51.11, 56.3, 53.1, 53.3, 53.5, 108/57.21–57.24, 57.29, 57.31–57.33; 248/346.02, 94, 246.5, 188.8; 206/386, 206/597, 600
See application file for complete search history.

(56) References Cited

U.S. PATENT DOCUMENTS

| | | | | |
|---|---|---|---|---|
| 2025/0178784 | A1* | 6/2025 | Ye | B65D 19/0075 |
| 2025/0382094 | A1* | 12/2025 | Hao | B65D 19/0006 |

FOREIGN PATENT DOCUMENTS

| | | | | | |
|---|---|---|---|---|---|
| CN | 110589176 | A | * | 12/2019 | B65D 21/0209 |
| EP | 2163486 | A2 | * | 3/2010 | B65D 19/385 |
| GB | 937354 | A | * | 9/1963 | B65D 19/40 |
| WO | WO-0078620 | A1 | * | 12/2000 | B65D 19/0083 |

* cited by examiner

CARRYING PALLET

CROSS-REFERENCE TO RELATED APPLICATION

This patent application claims the benefit and priority of Chinese Patent Application No. 2024213826076, entitled "NOVEL CARRYING PALLET" filed on Jun. 17, 2024, the disclosure of which is incorporated by reference herein in its entirety as part of the present application.

TECHNICAL FIELD

The present disclosure relates to the technical field of pallet structures, and more specifically relates to a novel carrying pallet.

BACKGROUND

At present, the existing carrying pallets are usually made of plastic materials and wooden materials. Although plastic pallets and wooden pallets can carry loads and realize loading, unloading, handling, packaging, transportation and storage, the carrying weight is limited. When more than ten tons of articles need to be loaded, the plastic pallets and the wooden pallets cannot carry them, and iron (steel) pallets need to be used. At the same time, the feet of the plastic pallet are usually integrally formed with the pallet body, but the foot of the wooden pallet is only a piece of wood. The distance between an pallet upper and a lower pallet is large when the wood pallets and the plastic pallets are stacked, such that a large space is occupied.

At present, most of the existing standard iron pallets are in the structural forms of the plastic pallets or the wooden pallets. In addition to the above-mentioned shortcomings of the plastic and the wooden pallets, the carrying capacity is only increased by the characteristics of iron materials, but the carrying weight is still limited. When more than ten tons of articles need to be carried, the standard iron pallets on the market can no longer carry the articles, and a special steel frame needs to be manufactured.

SUMMARY

Aiming at the disadvantages in the prior art, the present disclosure provides a novel carrying pallet. The novel carrying pallet is provided with a frame, a support structure and feet. Large weight can be carried. At the same time, the feet with special structures are adopted, and the distance between an pallet upper and a lower pallet is small when the pallets are stacked, such that the stacked occupation space is small.

To achieve the above purpose, the present disclosure provides the following technical scheme.

A novel carrying pallet includes a frame and a support structure located inside the frame. The support structure includes multiple first rectangular tubes with square cross sections, multiple support pillars and a connecting plate. The multiple first rectangular tubes are distributed side by side, and two ends of each of the multiple first rectangular tubes are connected with the frame. An outer side of the connecting plate is connected with the frame. The multiple support pillars are located on the multiple first rectangular tubes and are vertically arranged. The multiple support pillars are connected with the multiple first rectangular tubes and the connecting plate. Each corner of the frame is provided with a foot.

The connecting plate is located below the frame.

Further, the frame includes multiple second rectangular tubes with square cross sections. The multiple second rectangular tubes are connected in sequence in an end to end manner to form a rectangular frame. The connecting plate is connected with the multiple second rectangular tubes. Two ends of each of the multiple first rectangular tubes are respectively connected with two second rectangular tubes, which are oppositely arranged, of the multiple second rectangular tubes. The foot is installed at a joint of every two adjacent second rectangular tubes of the multiple second rectangular tubes.

Further, the frame includes multiple third rectangular tubes with square cross sections. The multiple third rectangular tubes are connected in sequence in an end to end manner to form a rectangular frame. The connecting plate is connected with the multiple third rectangular tubes. Each of the multiple third rectangular tubes is internally provided with a plurality of first columns. Two ends of each of the multiple first rectangular tubes are respectively connected with two third rectangular tubes, which are oppositely arranged, of the multiple third rectangular tubes. The foot is installed between every two adjacent third rectangular tubes of the multiple third rectangular tubes.

A novel carrying pallet includes a frame and a support structure located inside the frame. The support structure includes multiple first rectangular tubes with square cross sections, multiple support pillars and a connecting plate. The multiple first rectangular tubes are distributed side by side, and two ends of each of the multiple first rectangular tubes are connected with the frame. An outer side of the connecting plate is connected with the frame. The multiple support pillars are located on the multiple first rectangular tubes and are vertically arranged. The multiple support pillars are connected with the multiple first rectangular tubes and the connecting plate. Each corner of the frame is provided with a foot. The frame includes multiple frame structures. Each of the multiple frame structures includes a frame side plate, a fourth rectangular tube with a square cross section, multiple second columns and a frame plate. The multiple second columns are vertically arranged, and two ends of each of the multiple second columns are respectively connected with the fourth rectangular tube and the frame plate. The frame side plate, the fourth rectangular tube and the frame plate in each of the multiple frame structures are connected in sequence in an end to end manner to form a rectangular frame. Two ends of each of the multiple first rectangular tubes are respectively connected with two fourth rectangular tubes which are oppositely arranged. The foot is installed between every two adjacent fourth rectangular tubes and the frame plate.

Further, two ends of each of the multiple first rectangular tubes are respectively located above or below the two fourth rectangular tubes which are oppositely arranged and are connected with the two fourth rectangular tubes.

Further, the foot includes a guide portion and a support portion located below the guide portion. An opening is formed in a top of the guide portion. The guide portion is internally provided with a stretching space in a shape of a reverse taper. A cavity is formed in the support portion. The cavity is connected with the stretching space. The guide portion is connected with the frame.

Further, multiple first mating holes are formed in the connecting plate.

Further, a plurality of second mating holes are formed in each of the multiple first rectangular tubes and the frame.

Compared with the prior art, the embodiments have the following beneficial effects.

In the present disclosure, the pallet structure is provided with the frame, the support structure and the feet. The support structure is provided in the structural form of the multiple first rectangular tubes, the multiple support pillars and the connecting plate. The support pillars are configured for carrying stress load. The connecting plate plays a role in stabilizing the support pillars by gathering the support pillars together, and the connecting plate can bear certain stress load. The first rectangular tubes play a role in fixing the support pillars, and form a rectangular beam structure together with the support pillars, such that high torsion resistance and bending resistance can be born. Moreover, the stress load is transmitted to the frame again and transmitted to the feet by the frame, such that high weight can be carried.

At the same time, the frame structure is adopted in any structural form of the multiple second rectangular tubes, the multiple frame structures and the multiple first columns embedded in the third rectangular tubes, which can be freely selected according to the advantages of the three frames, and the frame structure is matched and connected with the support structure and the feet, such that the integral stability can be improved while the carrying capacity is increased to realize large-weight carrying.

Moreover, the foot includes the guide portion and the support portion located below the guide portion, and is provided with the opening, the stretching space and the cavity in a shape of a reverse taper, such that when the pallets are stacked, the foot of the pallet can stretch into the stretching space and the cavity of the lower pallet to realize no large space between the upper pallet and the lower pallet during stacking, and the space is effectively saved.

BRIEF DESCRIPTION OF THE DRAWINGS

In order to illustrate the technical scheme in the embodiment of the present disclosure more clearly, the drawings needing to be used in the embodiment are simply described.

Apparently, the embodiments in the following description are merely some embodiments of the present disclosure. For those skilled in the art, under the premise of without contributing creative labor, otherwise than drawings further can be obtained according to these drawings.

Figure 1:
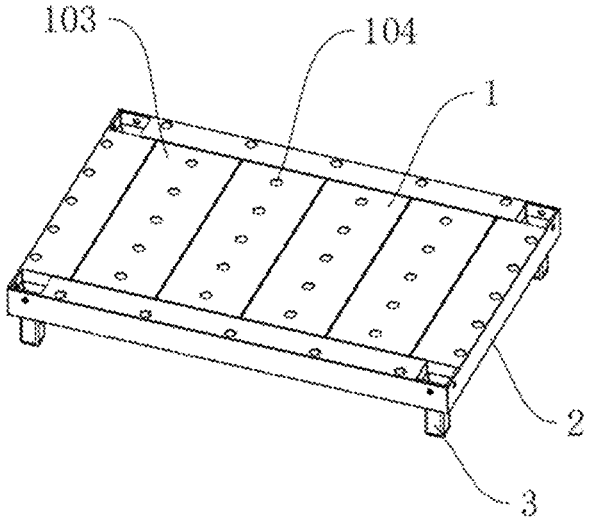
FIG. 1 is a first structural schematic diagram of a novel carrying pallet (according to the first embodiment).

List of the reference characters: 1 support structure; 101 first rectangular tube; 102 support pillar; 103 connecting plate; 104 first mating hole; 105 second mating hole; 2 frame; 201 second rectangular tube; 202 fourth rectangular tube; 203 second column; 204 frame plate; 205 frame side plate; 206 third rectangular tube; 207 first column; 3 foot; 301 guide portion; 302 support portion; 303 stretching space; and 304 cavity.

DETAILED DESCRIPTION OF THE EMBODIMENTS

In the description of the present disclosure, it needs to be illustrated that for location words, the indicative direction or position relations of the terms such as "center", "transverse (X)", "longitudinal (Y)", "vertical (Z)", "length", "width", "thickness", "upper", "lower", "front", "rear", "left", "right", "vertical", "horizontal", "top", "bottom", "inside", "outside", "clockwise" and "anti-clockwise" are direction or position relations illustrated based on the drawings, just for facilitating the description of the present disclosure and simplifying the description, but not for indicating or hinting that the indicated device or element must be in a specific direction and is constructed and operated in the specific direction, the terms cannot be understood as the restriction of the present disclosure.

In addition, the terms "first" and "second" are merely intended for a purpose of description, and shall not be understood as an indication or implication of relative importance or implicit indication of the number of indicated technical features. Therefore, a feature limited by "first" or "second" may explicitly or implicitly include one or more features. In the description of the present disclosure, "multiple" and "a plurality of" mean two or more unless expressly specifically defined otherwise.

Embodiment I

Figure 2:
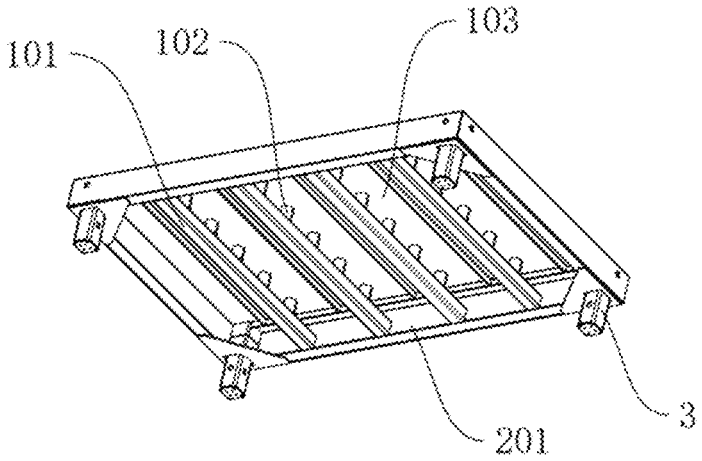
FIG. 2 is a second structural schematic diagram of a novel carrying pallet (according to the first embodiment).
Figure 3:
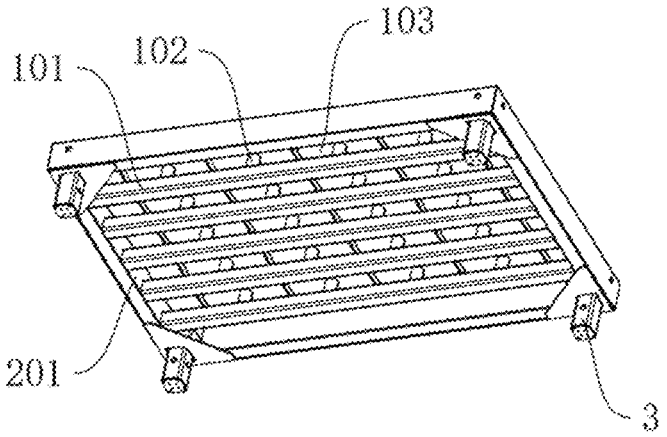
FIG. 3 is a third structural schematic diagram of the novel carrying pallet (according to the first embodiment).

A novel carrying pallet, as shown in FIG. 1 to FIG. 3, includes a frame 2 and a support structure 1 located inside the frame 2. The support structure 1 includes multiple first rectangular tubes 101 with square cross sections, multiple support pillars 102 and a connecting plate 103. The multiple first rectangular tubes 101 are distributed side by side, and two ends of the first rectangular tube 101 are connected with the frame 2. The outer side of the connecting plate 103 is connected with the frame 2. The multiple support pillars 102 are located on the first rectangular tubes 101 and are vertically arranged. The multiple support pillars 102 are connected with the first rectangular tubes 101 and the connecting plate 103. Feet 3 are arranged at the corners of the frame 2.

The connecting plate 103 can be formed by combining multiple connecting split plates.

Preferably, the frame 2 includes multiple second rectangular tubes 201 with square cross sections. The multiple second rectangular tubes 201 are connected in sequence in an end to end manner to form a rectangular frame 2. The connecting plate 103 is connected with the multiple second rectangular tubes 201. Two ends of the first rectangular tube 101 are respectively connected with two second rectangular tubes 201 which are oppositely arranged. The foot 3 is installed at the joint of every two adjacent second rectangular tubes 201.

Preferably, as shown in FIG. 2 to FIG. 3, the first rectangular tubes 101 are horizontally transversely or horizontally vertically arranged inside the frame 2.

Preferably, the foot 3 includes a guide portion 301 and a support portion 302 located below the guide portion 301. An opening is formed in the top of the guide portion 301. The guide portion 301 is internally provided with a stretching space 303 in a shape of a reverse taper. A cavity 304 is formed in the support portion 302. The cavity 304 is connected with the stretching space 303. The guide portion 301 is connected with the frame.

Preferably, multiple first mating holes 104 are formed in the connecting plate 103, such that auxiliary tools of the pullet can be connected and fixed through the first mating holes 104.

In the embodiment, the support structure 1 is provided in the structural form of the multiple first rectangular tubes 101, the multiple support pillars 102 and the connecting plate 103. The support pillars 102 are configured for bearing stress load. The connecting plate 103 plays a role in stabilizing the support pillars 102 by gathering the support pillars 102 together, and the connecting plate 103 can bear certain stress load. The first rectangular tubes 101 play a role in fixing the support pillars 102, and form a rectangular beam structure together with the support pillars 102, such that high torsion resistance and bending resistance can be born. Moreover, the stress load is transmitted to the frame 2 again and transmitted to the feet 3 by the frame 2, such that high weight can be carried.

At the same time, in the embodiment, the frame 2 is provided with the multiple second rectangular tubes 201. The second rectangular tubes 201 are connected in sequence in an end to end manner to form a rectangular frame 2. Two ends of the first rectangular tube 101 are connected with the second rectangular tube 201. The foot 3 is installed at the joint of every two adjacent second rectangular tubes 201. The pallet is simple in structure and high in stress carrying capability.

Moreover, in the embodiment, the foot 3 includes the guide portion 301 and the support portion 302 located below the guide portion 301, and is provided with the opening, the stretching space 303 in a shape of a reverse taper and the cavity 304, such that when the pallets are stacked, the feet 3 of the pallet can stretch into the stretching space 303 and the cavity 304 of the lower pallet respectively to realize no large space between upper and lower pallets during stacking, and the space is effectively saved.

Embodiment II

Figure 4:
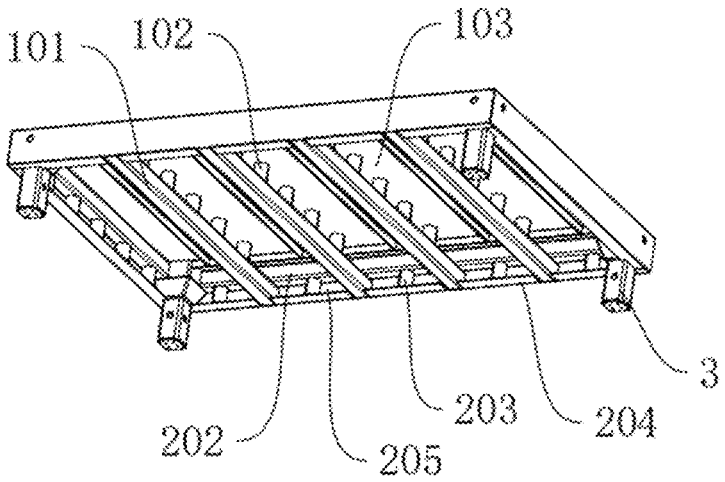
FIG. 4 is a fourth structural schematic diagram of the novel carrying pallet (according to the second embodiment).
Figure 5:
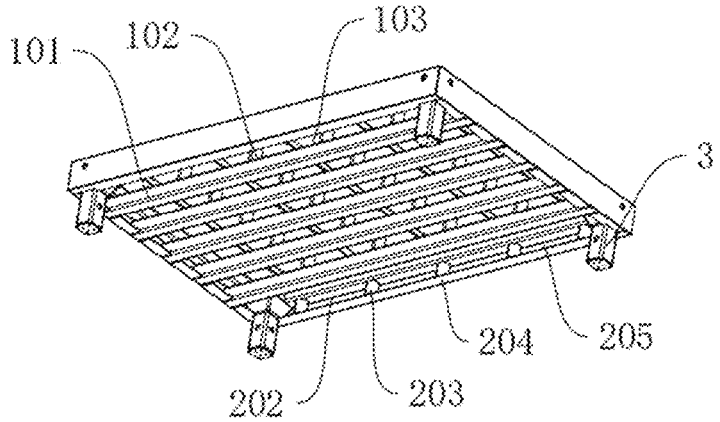
FIG. 5 is a fifth structural schematic diagram of the novel carrying pallet (according to the second embodiment).

As shown in FIG. 4 to FIG. 5, the remaining features of a novel carrying pallet are the same as those in the embodiment I. The difference lies in that the frame 2 includes multiple frame structures. The frame structure includes a frame side plate 205, a fourth rectangular tube 202 with a square cross section, multiple second columns 203 and a frame plate 204. The multiple columns are vertically arranged, and two ends of the column are respectively connected with the fourth rectangular tube 202 and the frame plate 204. The frame side plate 205, the fourth rectangular tube 202 and the frame plate 204 in the multiple frame structure are connected in sequence in an end to end manner to form a rectangular frame 2. Two ends of the first rectangular tube 101 are respectively connected with two opposite fourth rectangular tubes 202. The foot 3 is installed between every two adjacent fourth rectangular tubes 202 and the frame plate 204.

Preferably, two ends of the first rectangular tube 101 are respectively located above or below the two fourth rectangular tubes 202 which are oppositely arranged and are connected with the fourth rectangular tubes 202.

In the embodiment, the frame 2 is provided with the multiple frame structures, and the frame structure includes the frame side plate 205, the fourth rectangular tube 202, the multiple second columns 203 and the frame plate 204, such that the frame structure is also a rectangular beam structure, and has high bearing stress load and bending resistance. Moreover, a stable stress structure is formed through vertical crossed and overlapped connection of the fourth rectangular tube 202 and the third rectangular tube 206, such that high stress load can be carried.

Embodiment III

Figure 6:
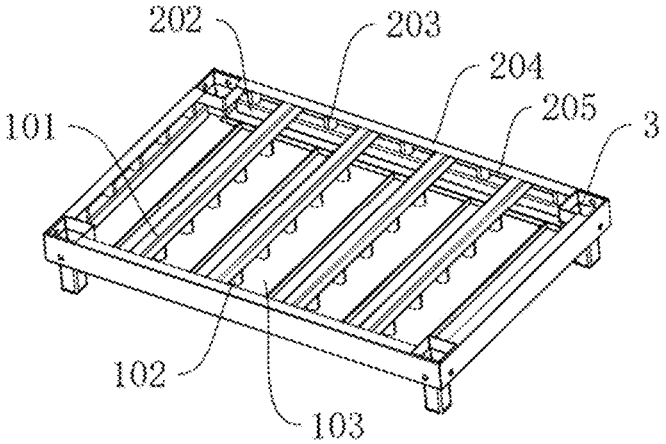
FIG. 6 is a sixth structural schematic diagram of a novel carrying pallet (according to the third embodiment).
Figure 7:
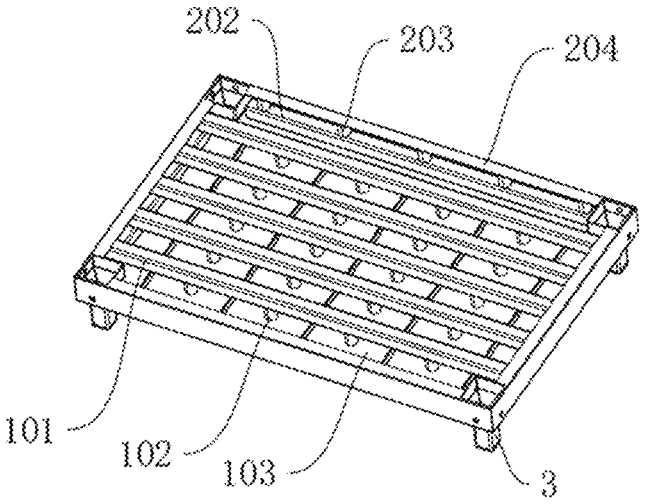
FIG. 7 is a seventh structural schematic diagram of the novel carrying pallet (according to the third embodiment).

As shown in FIG. 6 to FIG. 7, the remaining features of a novel carrying pallet are the same as those in the embodiment II. The difference lies in that the connecting plate 103 is located below the frame 2.

In the embodiment, the connecting plate 103 is located below the frame 2, such that the stress structure of the pallet in the embodiment III and the stress structure of the pallet in the embodiment II are inversed, which have the same stress carrying performance and have the effects of receiving liquid and dust.

Embodiment IV

Figure 8:
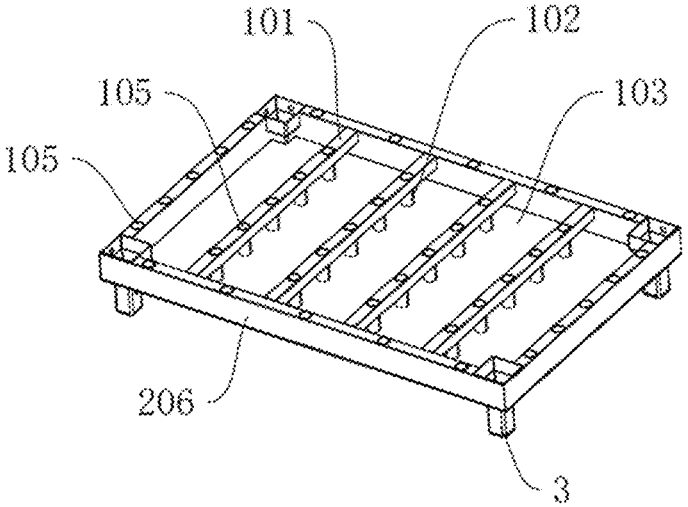
FIG. 8 is an eighth structural schematic diagram of a novel carrying pallet (according to the fourth embodiment).
Figure 9:
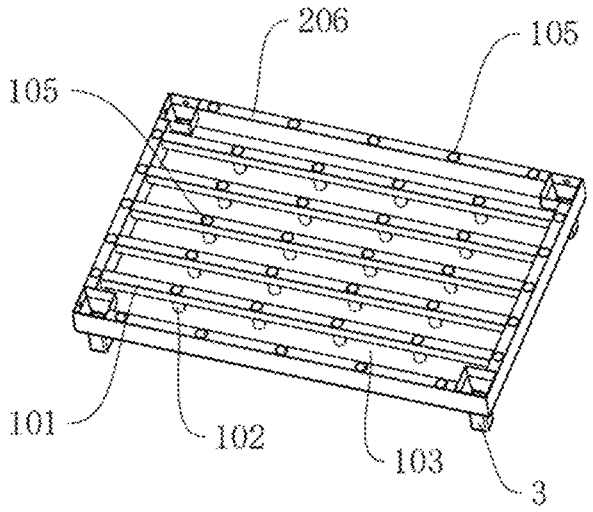
FIG. 9 is a ninth structural schematic diagram of the novel carrying pallet (according to the fourth embodiment).
Figure 10:
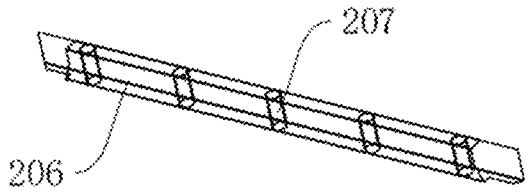
FIG. 10 is a structural schematic diagram of a third rectangular tube.
Figure 11:
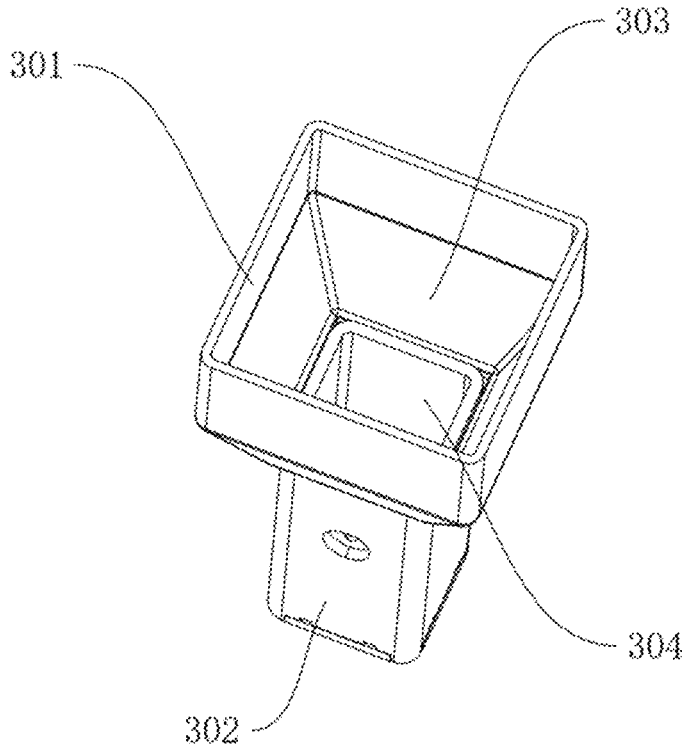
FIG. 11 is a structural schematic diagram of a foot.

A novel carrying pallet, as shown in FIG. 8 to FIG. 9, includes a frame 2 and a support structure 1 located inside the frame 2. The support structure 1 includes multiple first rectangular tubes 101, multiple support pillars 102 and a connecting plate 103. The multiple first rectangular tubes 101 are distributed side by side, and two ends of the first rectangular tube 101 are connected with the frame 2. The outer side of the connecting plate 103 is connected with the frame 2. The multiple support pillars 102 are located on the first rectangular tubes 101 and are vertically arranged. The multiple support pillars 102 are connected with the first rectangular tubes 101 and the connecting plate 103 respectively. Feet 3 are arranged at the corners of the frame 2.

Preferably, the connecting plate 103 is located below the frame 2.

Preferably, the frame 2 includes multiple third rectangular tubes 206 with square cross sections. The multiple third rectangular tubes 206 are connected in sequence in an end to end manner to form a rectangular frame 2. The connecting plate 103 is connected with the multiple third rectangular tubes 206. The third rectangular tube 206 is internally provided with multiple first columns 207. Two ends of the first rectangular tube 101 are respectively connected with two third rectangular tubes 206 which are oppositely arranged. The foot 3 is installed between every two adjacent third rectangular tubes 206.

Preferably, the foot 3 includes a guide portion 301 and a support portion 302 located below the guide portion 301. An opening is formed in the top of the guide portion 301. The guide portion 301 is internally provided with a stretching space 303 in a shape of a reverse taper. A cavity 304 is formed in the support portion 302. The cavity 304 is connected with the stretching space 303. The guide portion 301 is connected with the frame.

Preferably, multiple second mating holes 105 are formed in the first rectangular tube 101 and the frame 2.

In the embodiment, the frame 2 is provided with multiple third rectangular tubes 206. The third rectangular tube 206 is internally provided with multiple first columns 207. In the structural form, the first column 207 is embedded into the third rectangular tube 206 to form a "rectangular box girder" structure. The first column 207 is wrapped with the third rectangular tube 206, such that the support stability of the first column 207 is improved. The third rectangular tube 206 is taken as a main structure for bearing load. The first column 207 is embedded, such that the bending resistance and the torsional strength of the third rectangular tube 206 are enhanced. Under the combined action, the integral stability of the pallet in the structural form is improved while the carrying capacity of the pallet is increased.

At the same time, the connecting plate 103 is also located below the frame 2, and has the effects of receiving liquid and dust.

The above mentioned is just the preferable embodiments of the present disclosure, the scope of protection of the present disclosure is not limited to the above embodiments, and the technical scheme in basically same means belongs to the scope of protection in the present disclosure. It should be noted that for those of ordinary skill in the art, several improvements and modifications may further be made without departing from the principle of the present disclosure.

What is claimed is:

1. A novel carrying pallet, comprising a frame and a support structure located inside the frame, wherein the support structure comprises a plurality of first rectangular tubes with square cross sections, a plurality of support pillars and a connecting plate, the plurality of first rectangular tubes are distributed side by side, two ends of each of the plurality of first rectangular tubes are connected with the frame, an outer side of the connecting plate is connected with the frame, the plurality of support pillars are located on the plurality of first rectangular tubes and are vertically arranged, the plurality of support pillars are connected with the plurality of first rectangular tubes and the connecting plate, and each corner of the frame is provided with a foot, wherein the connecting plate is located below the frame.

2. The novel carrying pallet according to claim 1, wherein the frame comprises a plurality of second rectangular tubes with square cross sections, the plurality of second rectangular tubes are connected in sequence in an end to end manner to form a rectangular frame, the connecting plate is connected with the plurality of second rectangular tubes, two ends of each of the plurality of first rectangular tubes are respectively connected with two second rectangular tubes, which are oppositely arranged, of the plurality of second rectangular tubes, and the foot is installed at a joint of every two adjacent second rectangular tubes of the plurality of second rectangular tubes.

3. The novel carrying pallet according to claim 1, wherein the frame comprises a plurality of third rectangular tubes with square cross sections, the plurality of third rectangular tubes are connected in sequence in an end to end manner to form a rectangular frame, the connecting plate is connected with the plurality of third rectangular tubes, each of the plurality of third rectangular tubes is internally provided with a plurality of first columns, two ends of each of the plurality of first rectangular tubes are respectively connected with two third rectangular tubes, which are oppositely arranged, of the plurality of third rectangular tubes, and the foot is installed between every two adjacent third rectangular tubes of the plurality of third rectangular tubes.

4. The novel carrying pallet according to claim 1, wherein the foot comprises a guide portion and a support portion located below the guide portion, an opening is formed in a top of the guide portion, the guide portion is internally provided with a stretching space in a shape of a reverse taper, a cavity is formed in the support portion, the cavity is connected with the stretching space, and the guide portion is connected with the frame.

5. The novel carrying pallet according to claim 1, wherein a plurality of second mating holes are formed in each of the plurality of first rectangular tubes and the frame.

6. A novel carrying pallet, comprising a frame and a support structure located inside the frame, wherein the support structure comprises a plurality of first rectangular tubes with square cross sections, a plurality of support pillars and a connecting plate, the plurality of first rectangular tubes are distributed side by side, two ends of each of the plurality of first rectangular tubes are connected with the frame, an outer side of the connecting plate is connected with the frame, the plurality of support pillars are located on the plurality of first rectangular tubes and are vertically arranged, the plurality of support pillars are connected with the plurality of first rectangular tubes and the connecting plate, and each corner of the frame is provided with a foot, wherein the frame comprises a plurality of frame structures, each of the plurality of frame structures comprises a frame side plate, a fourth rectangular tube with a square cross section, a plurality of second columns and a frame plate, the plurality of second columns are vertically arranged, two ends of each of the plurality of second columns are respectively connected with the fourth rectangular tube and the frame plate, the frame side plate, the fourth rectangular tube and the frame plate in each of the plurality of frame structures are connected in sequence in an end to end manner to form a rectangular frame, two ends of each of the plurality of first rectangular tubes are respectively connected with two fourth rectangular tubes which are oppositely arranged, and the foot is installed between every two adjacent fourth rectangular tubes and the frame plate.

7. The novel carrying pallet according to claim 6, wherein two ends of each of the plurality of rectangular tubes are respectively located above or below the two fourth rectangular tubes which are oppositely arranged and are connected with the two fourth rectangular tubes.

* * * * *